United States Patent [19]

McCormick

[11] Patent Number: 4,897,058

[45] Date of Patent: Jan. 30, 1990

[54] MARINE DEVICE WITH IMPROVED PROPELLER SHAFT BEARING CARRIER ARRANGEMENT

[75] Inventor: Daniel F. McCormick, Oshkosh, Wis.

[73] Assignee: Brunswick Corporation, Skokie, Ill.

[21] Appl. No.: 197,452

[22] Filed: May 23, 1988

[51] Int. Cl.[4] ..... B63H 5/10

[52] U.S. Cl. ..... 440/80; 416/129

[58] Field of Search ..... 440/78–83, 440/75; 416/128, 129 R, 129 A; 411/427

[56] References Cited

U.S. PATENT DOCUMENTS

| | | | |
|---|---|---|---|
| 1,932,523 | 10/1933 | Irgens | 440/78 X |
| 2,161,740 | 6/1939 | Eksergian | 411/427 X |
| 2,425,441 | 8/1947 | Riley | 440/75 |
| 2,672,115 | 3/1954 | Conover | 416/129 A |
| 3,492,966 | 2/1970 | Kiekhaefer | 440/75 |
| 3,727,574 | 4/1973 | Bagge | 440/75 |
| 4,311,470 | 1/1982 | Blanchard | 440/900 X |
| 4,317,655 | 3/1982 | Schiek | 440/78 |
| 4,793,773 | 12/1988 | Kinouchi et al. | 416/129 |

*Primary Examiner*—Sherman D. Basinger

*Attorney, Agent, or Firm*—Andrus, Sceales, Starke & Sawall

[57] ABSTRACT

A marine drive (1) for a boat (3) includes a construction wherein a propeller supporting bearing device (29, 40) is disposed in a recess (28, 39) inside the propeller hub (23, 22). A bearing carrier (24, 37) is concentrically associated with a propeller shaft (20, 18). The carrier is provided with a rearwardly extending nose portion (27, 38) which is telescoped within the forwardly facing recess in an adjacent rearward propeller hub. The propeller shaft is journalled in the bearing device which is disposed between the carrier and the shaft and within the recess. In one aspect of the invention, the carrier is prevented from rotating about the shaft axis (17). In another aspect, a sealing device (26) is disposed between the propeller shaft and the rear end portion (8a) of an adjacent supporting gear case (8). In the embodiment disclosed, dual propellers and dual bearing carriers are utilized, with bearing carrier noses disposed in recesses in both propeller hubs.

1 Claim, 1 Drawing Sheet

MARINE DEVICE WITH IMPROVED PROPELLER SHAFT BEARING CARRIER ARRANGEMENT

BACKGROUND AND SUMMARY OF THE INVENTION

This invention relates to marine drives, and more particularly to an improved propeller shaft bearing carrier arrangement in both outboard motor and stern drive applications.

Heretofore, the aft portion of the horizontal propeller shaft of a marine drive has been journalled in bearings disposed longitudiually spaced forwardly from the propeller hub. Maximum support of the associated parts has not been accomplished. Furthermore, in previous bearing carrier constructions for marine propeller shafts, the sealing means between the carrier and the gear case has been located just aft and closely adjacent the vertical main drive shaft, with portions of the gear case extending rearwardly from the seals. Corrosion between the bearing carrier and gear case has been observed with this construction.

It is an object of the present invention to provide bearing support to the propeller shaft as close to the center of the propeller as possible; and to reduce corrosion between the bearing carrier and gear case by reducing the possibility of penetration of ambient water into the gear case to avoid corrosion problems in a bearing carrier system.

In accordance with various aspects of the invention, a marine drive for a boat broadly includes a construction wherein the propeller supporting bearing device is disposed in a recess inside the propeller hub. In the present embodiment, a bearing carrier is concentrically associated with a propeller shaft. The carrier is provided with a rearwardly extending nose portion which is telescoped within a forwardly facing recess in an adjustment rearward propeller hub. The propeller shaft is journalled in the bearing device which is disposed between the carrier and the shaft and within the recess. In one aspect of the invention, the carrier is prevented from rotating about the shaft axis. In another aspect, a sealing device is disposed between the propeller shaft and the rear end portion of an adjacent supporting gear case. In the embodiment disclosed, dual propellers and dual bearing carriers are utilized, with bearing carrier noses disposed in recesses in both propeller hubs.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENT

Figures 1, 2, 3:
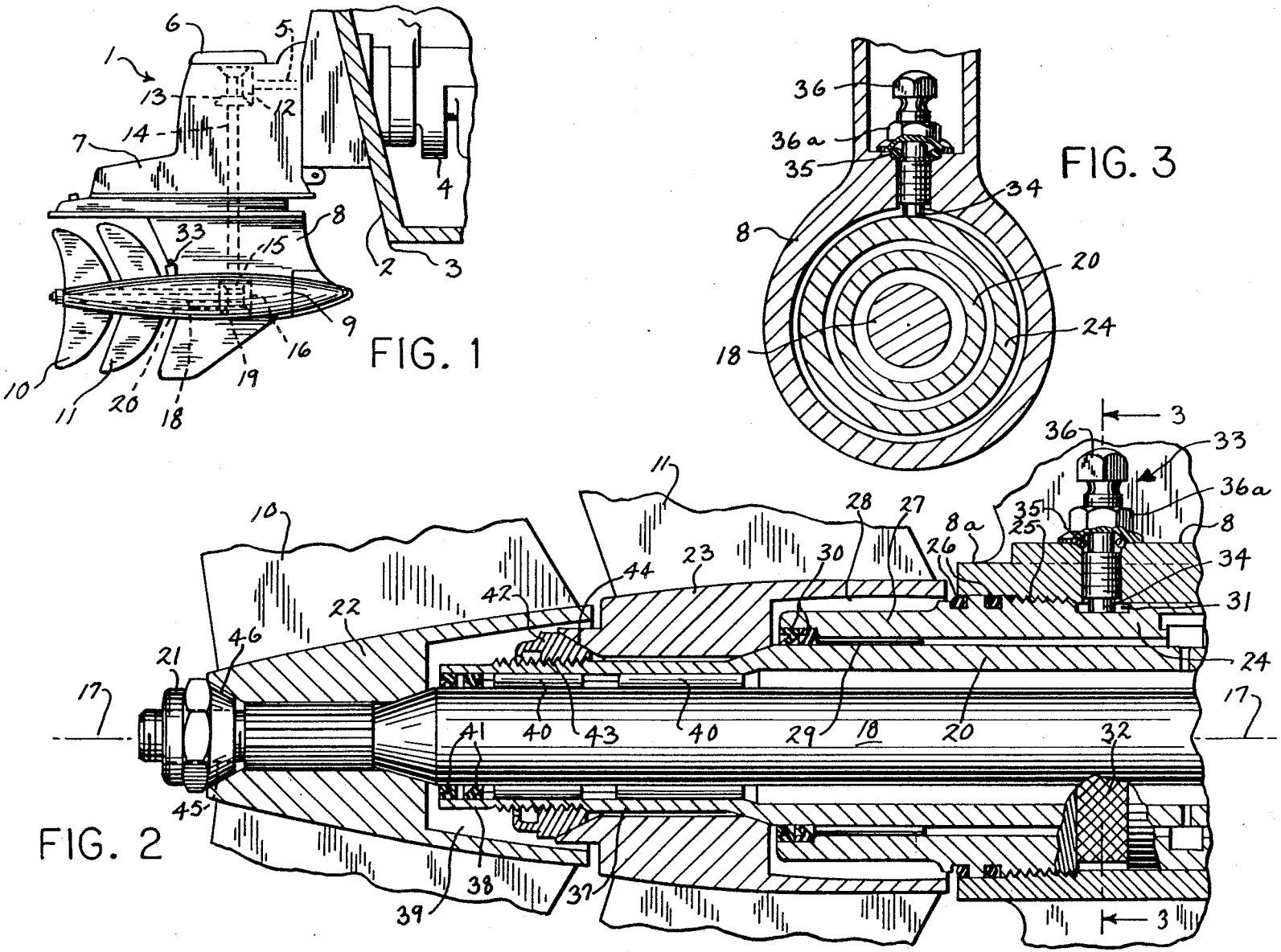
FIG. 1 is a generally schematic side elevation of a marine drive which incorporates various aspects of the invention.
FIG. 2 is an enlarged fragmentary view of the propeller mounting of the drive, and with parts broken away and in section.
FIG. 3 is a transverse section taken on line 3—3 of FIG. 2.

FIG. 1 of the drawings illustrates the present invention as applied to a marine stern drive unit, although the invention aspects are equally applicable to an outboard motor. As shown, stern drive unit 1 is adapted to be suitably mounted to the transom 2 of a boat 3. An internal combustion engine 4 is disposed within the boat and includes an output with a shaft 5 which extends through transom 2 to unit 1, in the usual manner.

Stern drive unit 1 generally includes a stern drive housing 6 forming an upper gear case 7, a lower gear case 8 suitably mounted to gear case 7, and a generally horizontally fore-to-aft extending torpedo housing 9 forming a portion of and disposed at the bottom of gear case 8.

Although certain aspects of the invention may be applicable to a single propeller device, in the present embodiment a pair of coaxially mounted propellers 10 and 11 are mounted for rotation generally aft of housing 9. For purposes of driving propellers 10 and 11, a pinion 12 is disposed on the outer end of shaft 5 and meshes with a gear 13 mounted to the upper end of a vertical main drive shaft 14 within upper gear case 7. Main drive shaft 14 extends downwardly and into lower gear case 8, and is provided with a pinion 15 on its lower end. Pinion 15 meshes with a forwardly disposed rearwardly facing driving gear 16 mounted for rotation about a horizontal propeller drive axis 17. Gear 16 is splined or otherwise mounted on and for rotation with a central axial longitudinally extending first propeller shaft 18.

Furthermore, pinion 15 meshes with a rearwardly disposed forwardly facing driving gear 19 which is also mounted for rotation about drive axis 17. Gear 19 forms the forward end portion of a longitudinally extending second propeller shaft 20 which is generally tubular and concentric with shaft 18.

As schematically shown in FIG. 1, rear propeller 10 is mounted to the rearward end of central first propeller shaft 18, while front propeller 11 is mounted to the rearward end of second propeller shaft 20, in any suitable well known manner. The result in this instance is to provide contra-rotating propellers.

Propeller shafts 18 and 20 are held in position within gear case 8 by means of a nut 21 threadably mounted on the rearmost end of propeller shaft 18. Reference is made to the present inventor's copending U.S. patent application Ser. No. 07/197,620, entitled "Marine Drive With Improved Propeller Mounting" and filed on even date herewith.

Propellers 10 and 11 are provided with hub portions 22 and 23 respectively.

In the present embodiment, the construction provides a bearing carrier for each of the propeller shafts. For this purpose, and referring first to outer propeller shaft 20, a cylindrical bearing carrier 24 is mounted concentrically over shaft 20 and forwardly of propeller 11. Carrier 24 is also mounted concentrically within an opening in lower gear case 8 and its intermediate portion is threaded into the latter, as at 25. Carrier 24 extends forwardly from the portion shown in FIG. 2 and terminates rearwardly of main drive shaft 14.

Sealing means are provided between carrier 24 and a rearward end portion **8*a* of gear case 8 to prevent ambient water from entering the latter and causing corrosion. For this purpose, one or more annular O-rings 26 are disposed between carrier 24 and gear case 8, and in the present embodiment are positioned rearwardly of threads 25 at the rear terminus 8*a*** of the gear case.

In addition, bearing carrier 24 is provided with a nose portion 27 which extends rearwardly from O-rings 26 and telescopes into a forwardly facing recess 28 disposed in forward propeller hub 23. A suitable bearing 29 and annular oil seals 30 are disposed at the rearward terminus of carrier 24 within recess 28. Propeller shaft 20 is journalled within bearing 29.

Furtheremore, means are provided to prevent rotation of bearing carrier 24 about axis 17 during operation of the drive. For this purpose, an annular peripheral groove 31 is disposed on carrier 24 and forwardly of threads 25, with groove 31 preferably being provided with a knurled or other irregular bottom surface 32. An adjustable set screw 33 threadably extends through gear case 8 and is provided with an inner end 34 which may be cup shaped to more firmly engage and embed in surface 32. Undesirable rotation of a tightened set arrow 33 is essentially prevented by an annular O-ring 35 which is disposed between the screw head 36 and gear case 8 around an unthreaded section of screw 33 and clamped in place by a lock nut **36*a***, which provides a further sealing function.

Turning now to the carrying of inner propeller shaft 18, tubular outer propeller shaft 20 is reduced in diameter at its rearward end portion 37 to form, in effect, a bearing carrier having a nose 38 which telescopes into a forwardly facing recess 39 disposed in aft propeller hub 22. Suitable bearings 40 and annular oil seals 41 are disposed at the rearward terminus of shaft 20 within recess 39. Propeller shaft 18 is journalled with bearing 40.

The bearing supporting portion of bearing carrier 24 can be extend rearwardly further than previously possible by providing a nut 42 which is threaded to shaft 20 as at 43 and which engages the rearward end of hub 23 by a set 44 of mating rearwardly inclined conical surfaces. Likewise, the bearing supporting portion of shaft 20 can be extended rearwardly further than previously possible by forming nut 21 so that it is threaded on shaft 18 as at 45 and which engages the rearward end of hub 22 by a set 46 of mating likewise rearwardly inclined surfaces. See also the present inventor's aforementioned copending patent application.

By extending bearing carrier 24 rearwardly beyond its supporting gear case 8, and by extending shaft 20 rearwardly beyond its supporting bearing carrier 24, and by providing telescoping of noses 27 and 38 within hub recesses 28 and 39, bearings 29 and 40 are disposed within propeller hubs 23 and 22 to maximize the bearing support for the propellers when the nuts are tightened. Furthermore, by placing the seals as far aft as possible, maximum sealing effect is obtained.

Various modes of carrying out the invention are contemplated as being within the scope of the following claims which particularly point out and distinctly claim the subject matter regarded as the invention.

I claim:

1. In a marine drive, the combination comprising:

(a) a generally vertical drive housing (6) terminating in a lower torpedo housing (9) forming part of a lower gear case (8), (b) first and second propeller shafts (18,20) disposed within said torpedo housing and extending longitudinally rearwardly in a generally fore-to-aft direction, and with said shafts being concentric and coaxially disposed for rotation on a longitudinal drive axis (17), (c) rearwardly and forwardly disposed propellers (10,11) disposed on the aft portions of said respective first and second shafts (18,20), and with said propellers having respective first and second hubs (22,23), (d) said first and second hubs having respective forwardly facing first and second recesses (39,28) disposed therein, (e) a first bearing carrier (37) mounted concentrically about said first propeller shaft (18) and with said first carrier having a first rearwardly extending nose portion (38) telescoped within said first recess (39), (f) a second bearing carrier (24) mounted concentrically about said second propeller shaft (20) and with said second carrier having a first rearwardly extending nose portion (27) telescoped within said second recess (28), (g) first bearing means (40) disposed between said first bearing carrier (37) and said first propeller shaft (18), (h) second bearing means (29) disposed between said second bearing carrier (24) and said second propeller shaft (20), (i) said first bearing means (40) being disposed within said first recess (39), (j) said second bearing means (29) being disposed within said second recess (28), (k) annular O-ring sealing means (26) disposed between said second bearing carrier (24) and said gear case (8) adjacent a rearward portion of the latter, (l) means (31,33) for preventing rotation of one of said bearing carriers (24) about said axis (17) during rotation of said propeller shafts, (m) and said first bearing carrier (37) for said first propeller shaft (18) being formed by a reduced rearward end portion (37) of said second propeller shaft (20).

* * * * *

UNITED STATES PATENT AND TRADEMARK OFFICE

CERTIFICATE OF CORRECTION

PATENT NO. : 4,897,058

DATED : January 30, 1990

INVENTOR(S) : Daniel F. McCormick

It is certified that error appears in the above-identified patent and that said Letters Patent is hereby corrected as shown below:

Column 1, line 39, delete "adjustment" and substitute therefore --adjacent--;

Column 1, line 68, delete "invention" and substitute therefore --inventive--.

Column 3, line 15, delete "arrow" and substitute therefore --screw--.

Claim 1, column 4, line 29, after "a" delete "first" and substitute therefore --second--.

Signed and Sealed this

Eighth Day of January, 1991

*Attest:*

HARRY F. MANBECK, JR.

*Attesting Officer*

*Commissioner of Patents and Trademarks*